US008850618B2

(12) United States Patent
Wu

(10) Patent No.: US 8,850,618 B2
(45) Date of Patent: Oct. 7, 2014

(54) COLLAPSIBLE HEAD COVERING DEVICE

(76) Inventor: Fu-Chi Wu, Northridge, CA (US)

( * ) Notice: Subject to any disclaimer, the term of this patent is extended or adjusted under 35 U.S.C. 154(b) by 215 days.

(21) Appl. No.: 13/421,955

(22) Filed: Mar. 16, 2012

(65) Prior Publication Data

US 2013/0239293 A1 Sep. 19, 2013

(51) Int. Cl.
*A42B 1/20* (2006.01)
*A42B 1/18* (2006.01)

(52) U.S. Cl.
USPC ..... 2/209.11; 2/171.03; 2/175.1; 2/175.6

(58) Field of Classification Search
CPC ..... A42B 1/201; A42B 1/205; A42B 1/206; A42B 1/20; A42B 1/006; A42B 1/18; A42B 1/064
USPC ..... 2/171.03, 209.11, 209.12, 175.4, 171.1, 2/182.2, 182.3, 182.7, 182.8, 175.1, 171, 2/175.2, 195.1, 195.2, 175.3–175.6, 2/209.13
See application file for complete search history.

(56) References Cited

U.S. PATENT DOCUMENTS 276,753 A * 5/1883 Bartine ..... 2/171.03
429,341 A * 6/1890 Field ..... 2/182.8
735,790 A * 8/1903 Meerza ..... 2/171.3
1,103,012 A * 7/1914 Smith et al. ..... 2/182.3
1,275,238 A * 8/1918 Freeman ..... 2/171.5
1,789,188 A * 1/1931 McGuigan ..... 2/181.6
2,070,442 A * 2/1937 McDonald ..... 2/181.4
2,149,468 A * 3/1939 Santise ..... 2/175.5
2,495,041 A * 1/1950 Weiss ..... 2/171.01
2,726,668 A * 12/1955 Levine ..... 2/171.03
3,234,563 A * 2/1966 Tabbat ..... 2/67
3,374,488 A * 3/1968 Erbb ..... 2/171.02
4,096,590 A * 6/1978 Keshock ..... 2/175.5
4,999,851 A * 3/1991 Hall ..... 2/175.5
5,548,846 A * 8/1996 Bianchetti ..... 2/209.12
5,857,219 A * 1/1999 Edmark ..... 2/182.2
5,950,241 A * 9/1999 Gomez ..... 2/172
6,256,794 B1 * 7/2001 Erickson ..... 2/209.11
6,484,323 B1 * 11/2002 Pu ..... 2/410
2011/0099692 A1 * 5/2011 Essex ..... 2/184.5
2012/0210491 A1 * 8/2012 Bryan et al. ..... 2/181.4
2014/0053316 A1 * 2/2014 Su ..... 2/172

* cited by examiner

*Primary Examiner* — Amy Vanatta
(74) *Attorney, Agent, or Firm* — Rosenberg, Klein & Lee

(57) ABSTRACT

A collapsible head covering device includes a wide-brimmed hat made of an anti-UV waterproof fabric and having a memory metal wire ring fastened to the border edge of the brim thereof, a cap detachably accommodated in the wide-brimmed hat for capping on the head of a person, and a fastening belt selectively inserted through multiple through holes on the wide-brimmed hat and multiple through holes on the cap to fasten the wide-brimmed hat to the cap in one of multiple different angular positions.

5 Claims, 10 Drawing Sheets

COLLAPSIBLE HEAD COVERING DEVICE

BACKGROUND OF THE INVENTION

1. Field of the Invention

The present invention relates to head coverings and more particularly, to a collapsible head covering device, which comprises a wide-brimmed hat made of an anti-UV waterproof fabric and having a memory metal wire ring fastened to the border edge of the brim thereof to facilitate collapsing, and a cap detachably fastenable to the inside of the wide-brimmed hat for capping on the head of a person.

2. Description of the Related Art

Carbon dioxide (CO2) emissions from automobiles and factories are a major contributor to the greenhouse effect and global climate change. Hydrocarbon emissions from automobiles are fragments of fuel molecules, only partially burned. Hydrocarbons react in the presence of nitrogen oxides and sunlight to form ground-level ozone, a major component of smog. Ozone irritates the eyes, nose and throat, and damages the lungs. Exposing to direct sunlight is harmful to the health. An athlete, farmer, outdoor worker, golf player or solder may be injured easily by sunlight after long exposure to the sun. Wearing a conventional sun visor, straw hat or army cap cannot effectively protect the user against the radiation of the light of the sun due to narrow shading area. Acidic rain and solar radiation are two main sources harmful to human body.

SUMMARY OF THE INVENTION

The present invention has been accomplished under the circumstances in view. It is one object of the present invention to provide a collapsible head covering device, which uses a memory metal wire ring (or resilient metal wire ring) to support an anti-UV waterproof fabric, cloth or any other sheet member in an extended condition for hanging on the head of a user to protect the user against the radiation of sunlight without giving a burden to the head of the user, allowing the user to work conveniently under the sun.

It is another object of the present invention to provide a collapsible head covering device, which is easily collapsible, and allows a wide-brimmed hat to be adjustably fastened to a cap in one of various different angles for protecting the user against sunlight and rain and allowing the user to carry things by hands or to work outdoor without an umbrella or raincoat.

It is still another object of the present invention to provide a collapsible head covering device, which has a memory metal wire ring (or resilient metal wire ring) fastened to the border edge thereof so that the user can collapse the collapsible head covering device conveniently by twisting the memory metal wire ring (or resilient metal wire ring) and then folding up the twisted memory metal wire ring (or resilient metal wire ring).

It is still another object of the present invention to provide a collapsible head covering device, which can be configured to fit the body of a person, protecting the user against sun damage.

BRIEF DESCRIPTION OF THE DRAWINGS

FIGS. 10~10-3 illustrate the collapsing operation of the collapsible head covering device in accordance with the second embodiment of the present invention.

DETAILED DESCRIPTION OF THE PREFERRED EMBODIMENT

Figure 1:
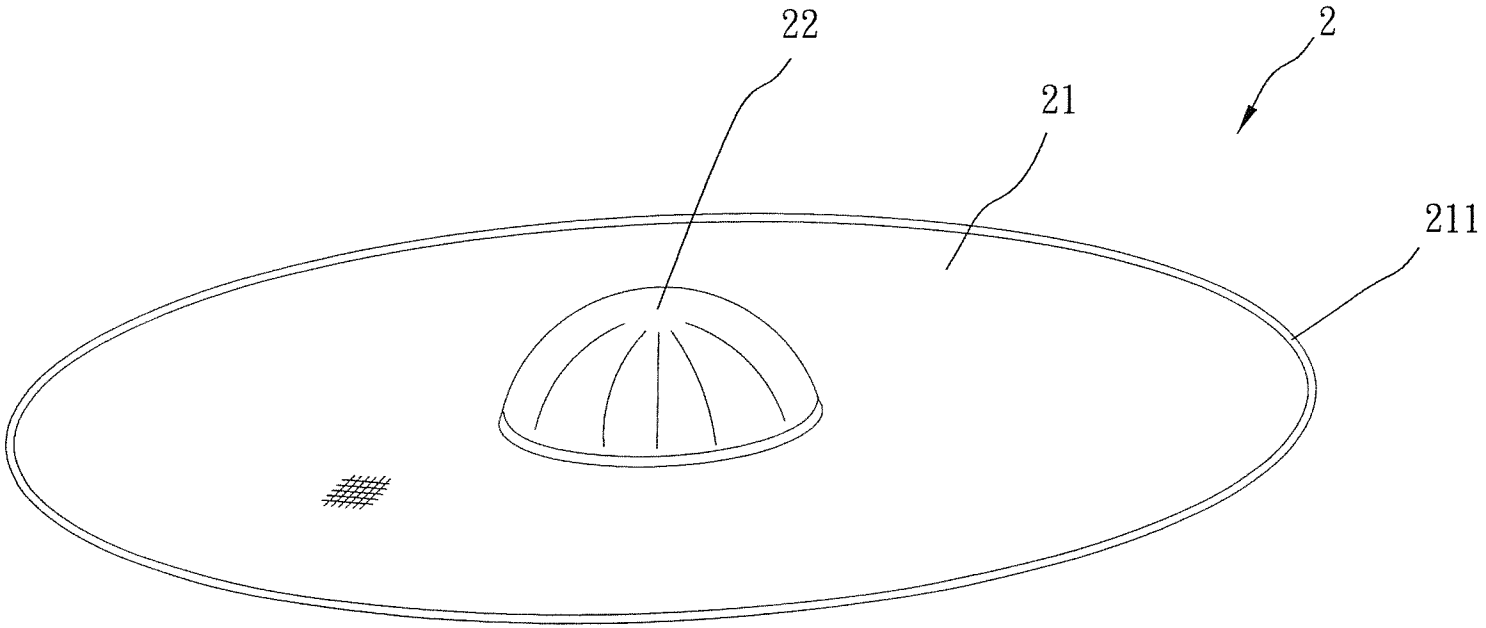
FIG. 1 is an elevational view of a wide-brimmed hat for collapsible head covering device in accordance with a first embodiment of the present invention.
Figure 2:
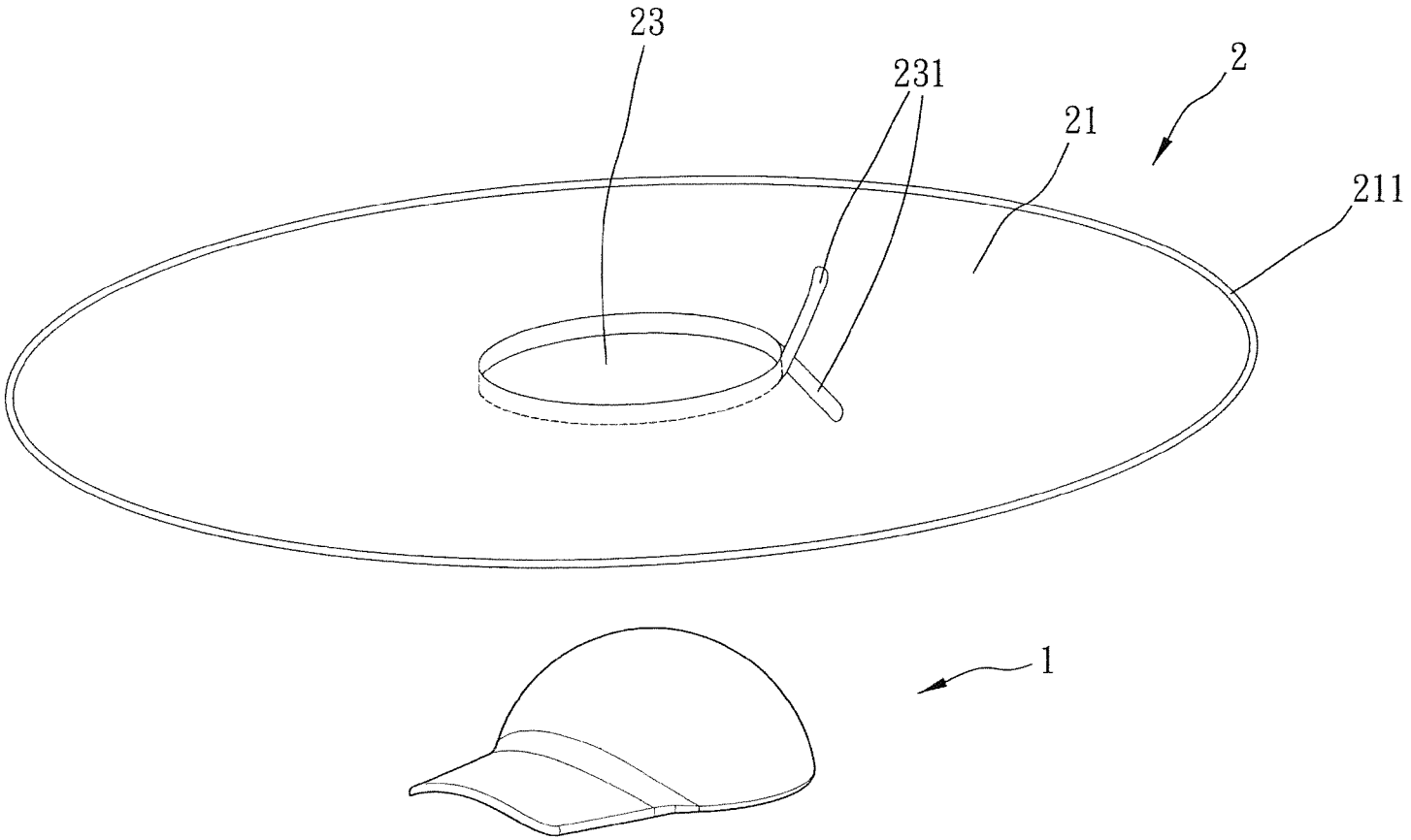
FIG. 2 illustrates wide-brimmed hat and a cap for collapsible head covering device in accordance with the first embodiment of the present invention.
Figure 3:
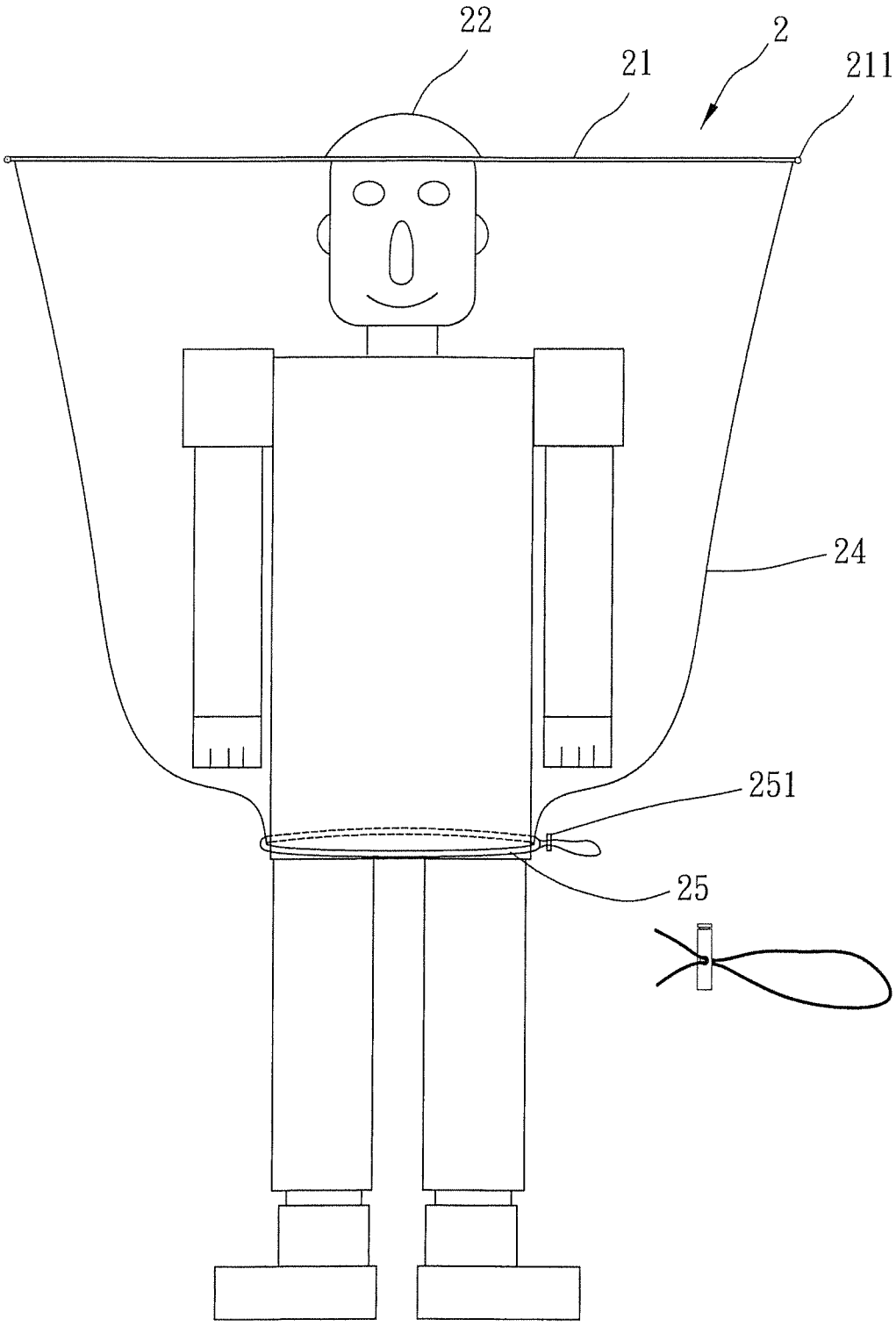
FIG. 3 is a schematic drawing of the collapsible head covering device in accordance with the first embodiment of the present invention.
Figure 4:
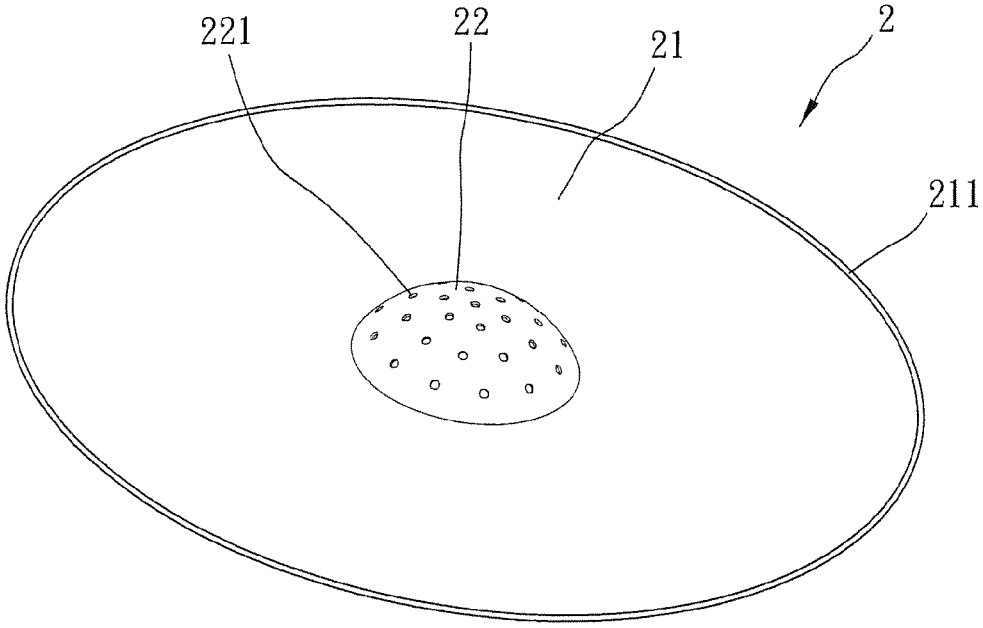
FIG. 4 is an elevational view of a wide-brimmed hat for collapsible head covering device in accordance with a second embodiment of the present invention.
Figure 5:
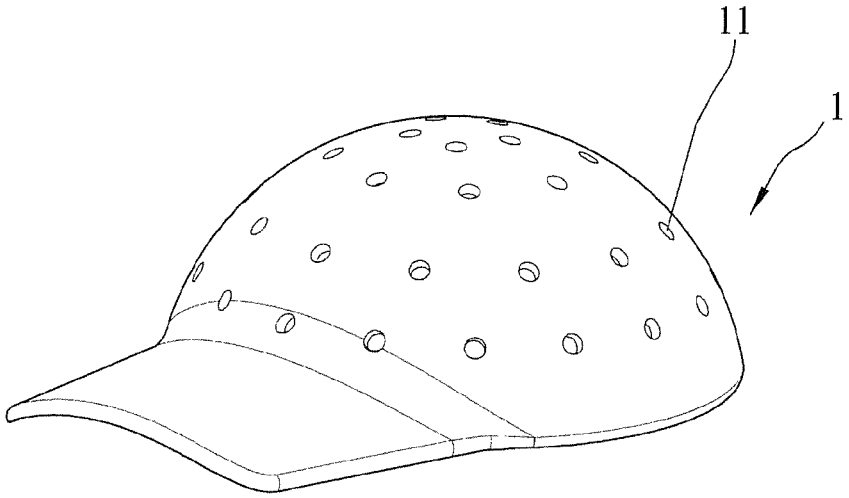
FIG. 5 is an elevational view of a cap for collapsible head covering device in accordance with the second embodiment of the present invention.
Figure 6:
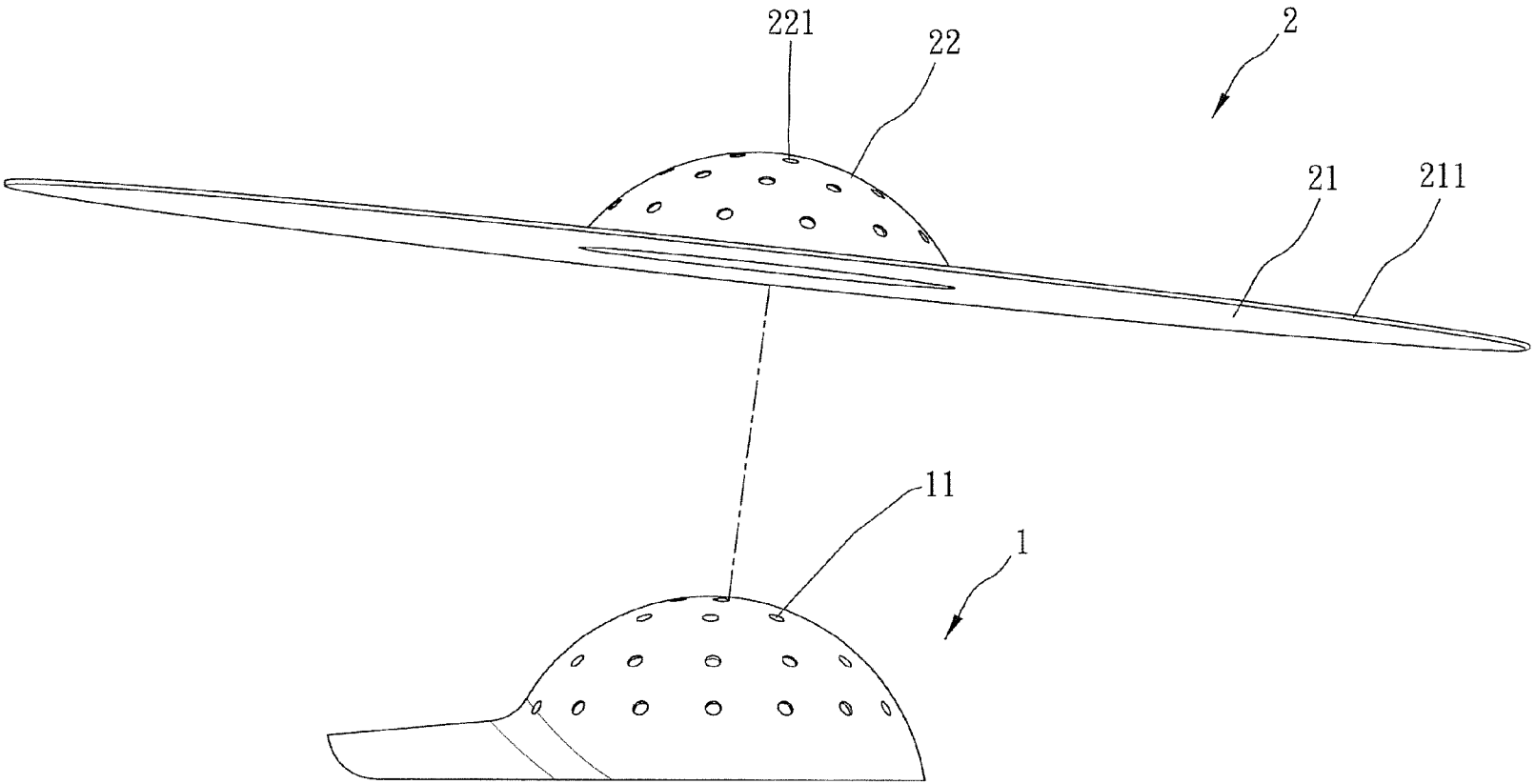
FIG. 6 is an exploded view of the collapsible head covering device in accordance with the second embodiment of the present invention (the fastening belt excluded).
Figure 7:
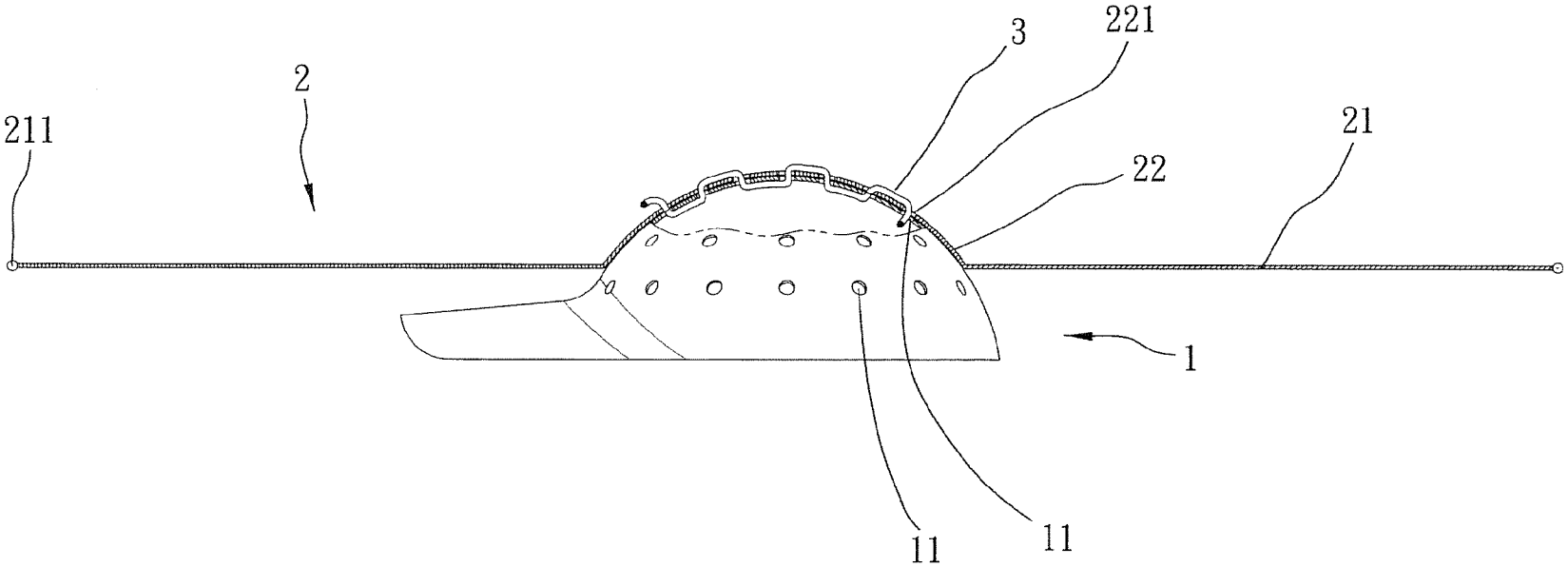
FIG. 7 is a schematic assembly view of the collapsible head covering device in accordance with the second embodiment of the present invention.

Referring to FIGS. 1, 2, and 3, a collapsible head covering device in accordance with a first embodiment of the present invention is shown comprising a wide-brimmed hat 2. The wide-brimmed hat 2 is made of an anti-UV waterproof fabric, cloth or any other sheet member, comprising a semispherical crown 22, a brim 21 extending around the semispherical crown 22 and a memory metal wire ring (or resilient metal wire ring) 211 fastened to the border edge of the brim 21. Twisting the memory metal wire ring 211 can collapse the wide-brimmed hat 2. The semispherical crown 22 is configured for attaching to the head of a user, enabling the wide-brimmed hat 2 to shade the user against the radiation of the sun or rain. The semispherical crown 22 defines a bottom accommodation chamber 23 for attaching to the head of a user directly. The collapsible hat further comprises a binding strap 231 partially affixed to the bottom side of the wide-brimmed hat 2 around the bottom accommodation chamber 23, a cap 1 detachably attached to the bottom accommodation chamber 23 and secured in place by the binding strap 231, a tubular anti-mosquito net 24 suspended from the border edge of the brim 21, an elastic band 25 fastened to the bottom open end of the tubular anti-mosquito net 24, and a cord lock 251 mounted at the elastic band 25 for allowing adjustment of the opening of the bottom open end of the tubular anti-mosquito net 24.

Figure 8:
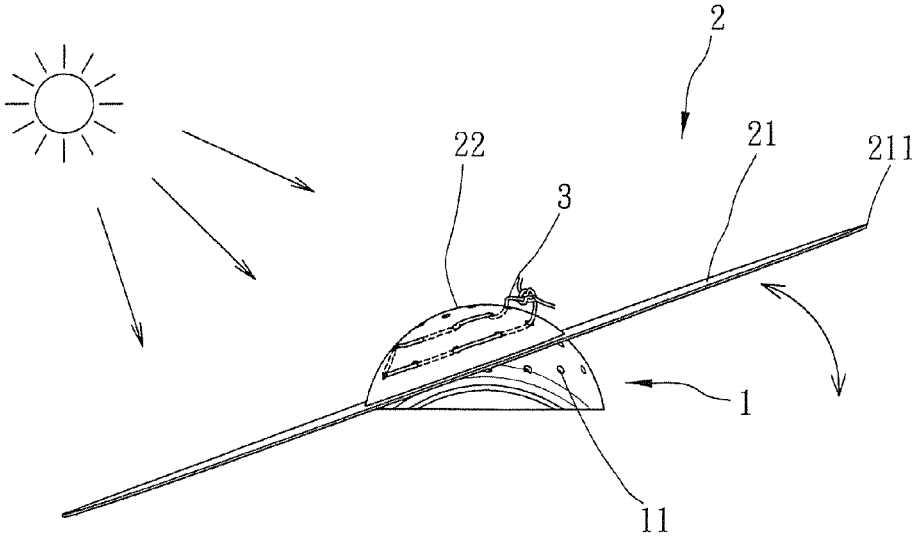
FIG. 8 is a schematic drawing of the second embodiment of the present invention, illustrating the wide-brimmed hat fastened to the cap in one angle.
Figure 9:
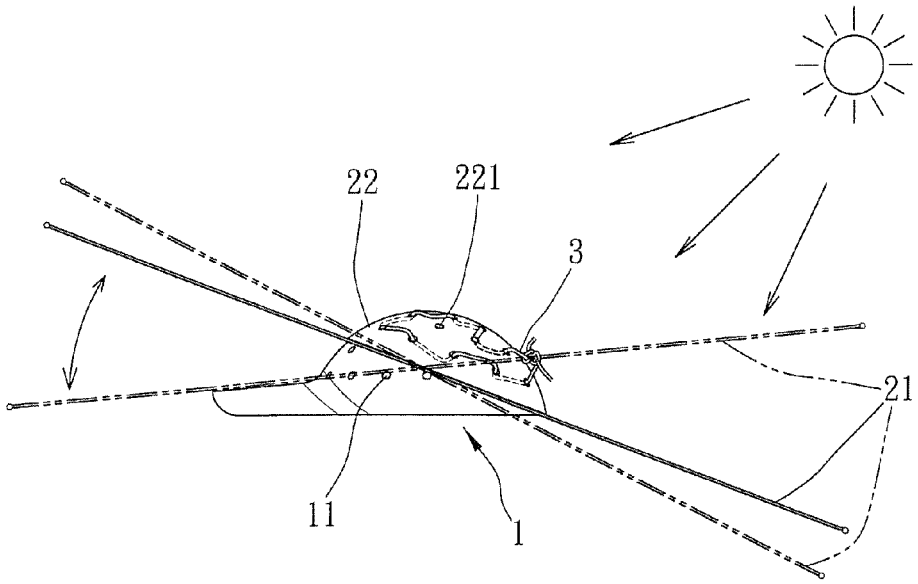
FIG. 9 corresponds to FIG. 8, illustrating the wide-brimmed hat adjusted to another angle relative to the cap.
Figures 2, 10:
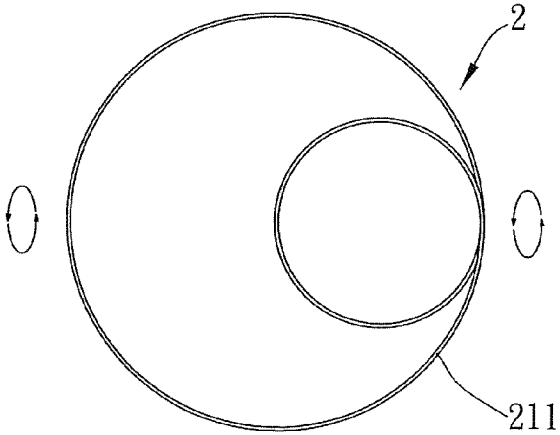
Figures 3, 10:
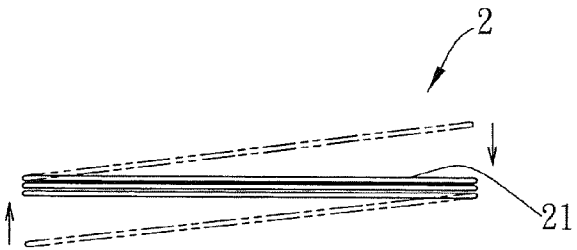
Figure 10:
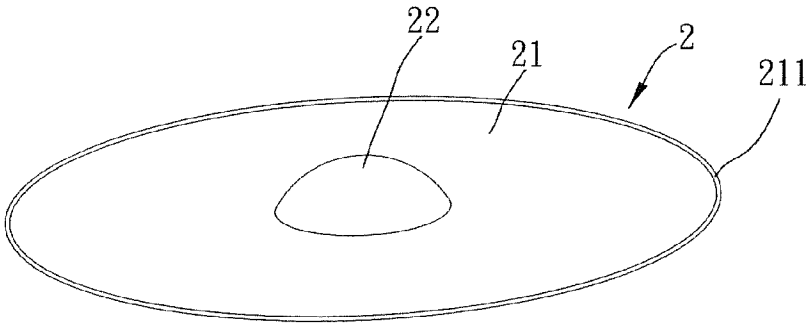
Figures 1, 10:
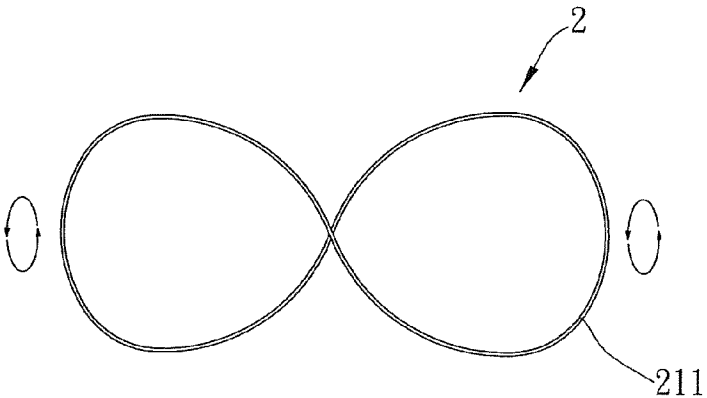

Referring to FIGS. 4-7, a collapsible head covering device in accordance with a second embodiment of the present invention is shown comprising a wide-brimmed hat 2, which comprises a semispherical crown 22, a plurality of through holes 221 cut through the semispherical crown 22, a brim 21 extending around the semispherical crown 22 and a memory metal wire ring (or resilient metal wire ring) 211 fastened to the border edge of the brim 21 for supporting the wide-brimmed hat 2 in shape, a cap 1 having a plurality of through holes 11 cut through opposing top and bottom sides thereof and attachable to the inside of the semispherical crown 22 for capping on the head of a user, and a fastening belt 3 insertable through the through holes 11 of the cap 1 and the through holes 221 of the wide-brimmed hat 2 to secure the cap 1 and the wide-brimmed hat 2 together. Thus, the collapsible head covering device can be capped on the head of a user to protect the user against sunlight or rain. Further, by means of selectively inserting the fastening belt 3 through the through holes 11 of the cap 1 and the through holes 221 of the wide-brimmed hat 2, the wide-brimmed hat 2 can be fastened to the cap 1 in any of various different angles subject to the radiating angle of the light of the sun (as shown in FIGS. 8 and 9). Further, by means of twisting the memory metal wire ring 211 and then folding up the twisted memory metal wire ring 211, the collapsible head covering device is collapsed (see FIGS. 10, 10-1, 10-2 and 10-3), minimizing the storage space. Further, hook and loop materials may be used for detachably and adjustably securing the wide-brimmed hat 2 to the cap 1 in any of various different angles.

Figure 11:
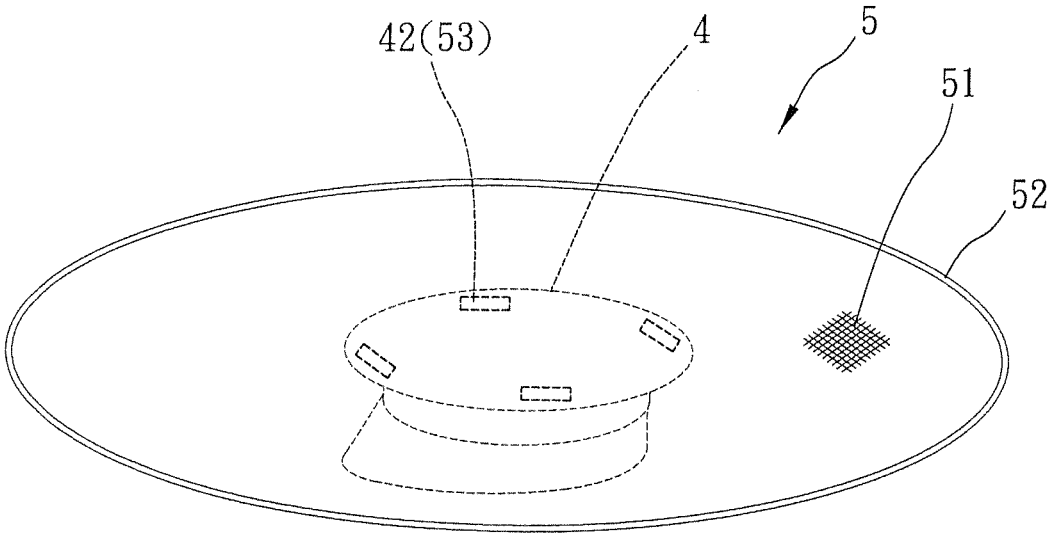
FIG. 11 is a perspective view of a collapsible head covering device in accordance with a third embodiment of the present invention.
Figure 12:
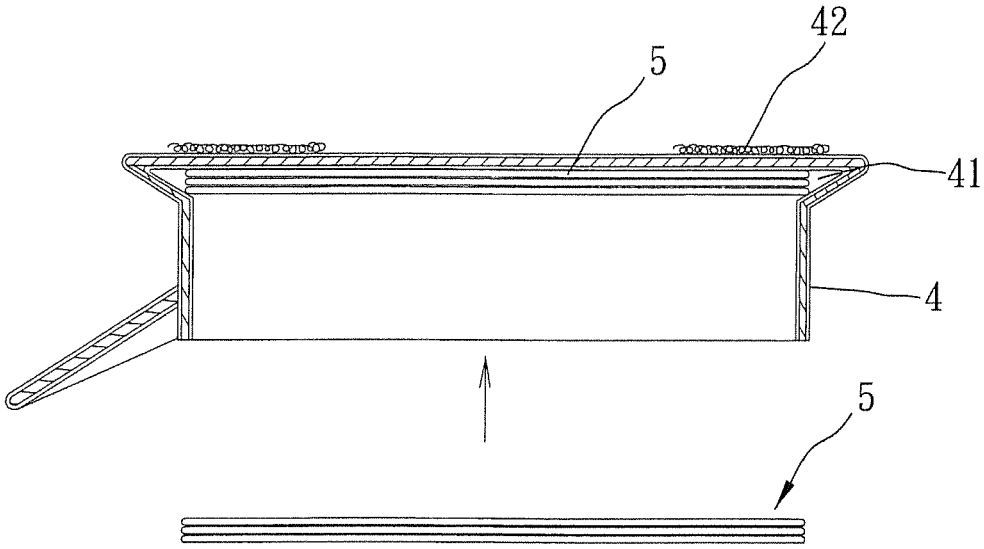
FIG. 12 is a schematic drawing illustrating the collapsing operation of the collapsible head covering device in accordance with the third embodiment of the present invention.

Referring to FIGS. 11 and 12, a collapsible head covering device in accordance with a third embodiment of the present invention is shown comprising a flat-head cap 4, which comprises a plurality of Velcro pads (hook and/or loop pads) 42 equiangularly located on the top side thereof, a flat sunshade 5, which comprises a sunshade body 51 made of an anti-UV waterproof fabric, cloth or any other sheet member, a memory metal wire ring (or resilient metal wire ring) 52 fastened to the border edge of the sunshade body 51 and a plurality of Velcro pads (loop and/or hook pads) 53 located on the bottom side thereof and detachably fastenable to the Velcro pads (hook and/or loop pads) 42 of the flat-head cap 4. The flat sunshade 5 can be collapsed by twisting the memory metal wire ring 52 and then folding it up, and then stored in the top inside space 41 in the flat-head cap 4, facilitating carrying.

Figure 14:
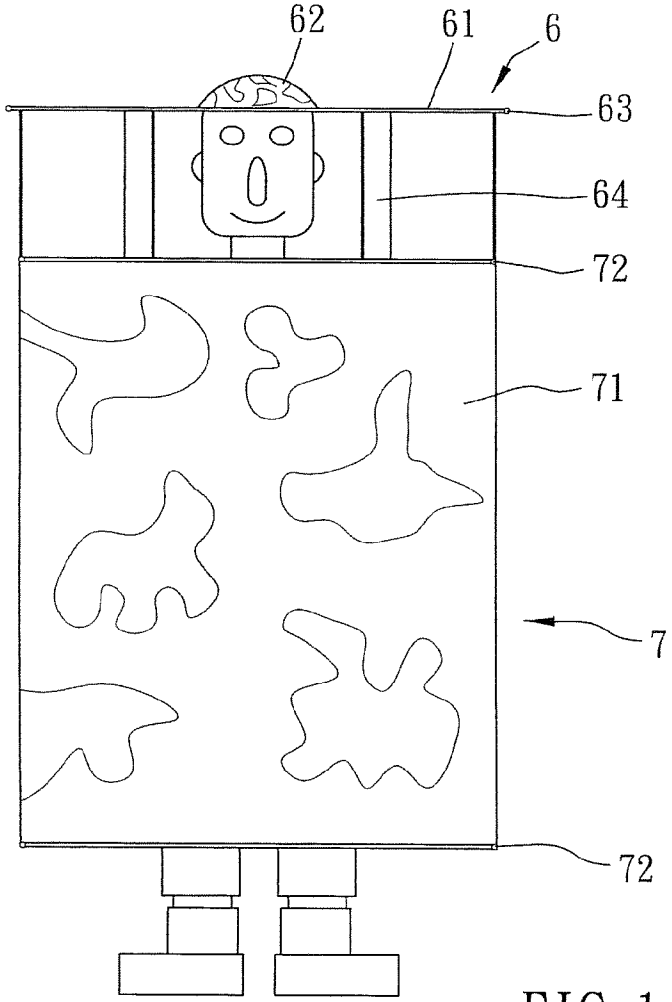
FIG. 14 is a schematic drawing illustrating a status of use of the collapsible head covering device in accordance with the fourth embodiment of the present invention.
Figure 13:
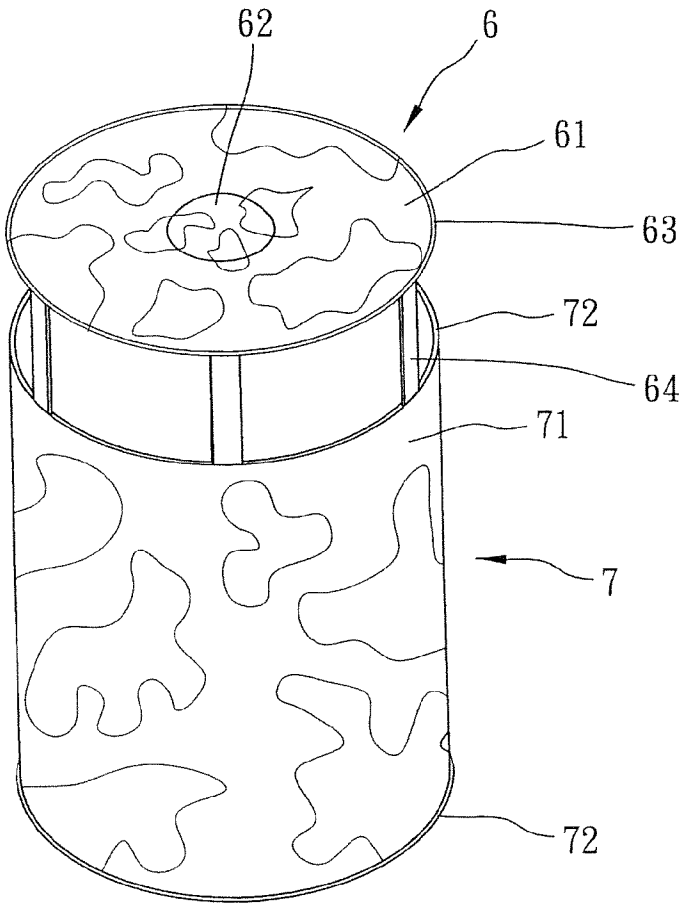
FIG. 13 is an elevational view of a collapsible head covering device in accordance with a fourth embodiment of the present invention.

Referring to FIGS. 13 and 14, a collapsible head covering device in accordance with a fourth embodiment of the present invention is shown comprising a wide-brimmed hat 6, a shade 7, and a plurality of connecting strips 64 connected between the wide-brimmed hat 6 and the shade 7. The wide-brimmed hat 6 is made of an anti-UV waterproof fabric, cloth or any other sheet member, comprising a semispherical crown 62, a brim 61 extending around the semispherical crown 62 and a memory metal wire ring (or resilient metal wire ring) 63 fastened to the border edge of the brim 61. The shade 7 comprises a tubular shade body 71 made of an anti-UV waterproof fabric, cloth or any other sheet member, and a memory metal wire ring (or resilient metal wire ring) 72 fastened to the bottom edge of the brim tubular shade body 71. By means of twisting the memory metal wire ring 63;72 and then folding them up, the collapsible head covering device is collapsed to minimize storage space.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. A collapsible head covering device, comprising:

a hat made of an anti-UV waterproof fabric, said hat comprising a semispherical crown defining a bottom accommodation open chamber, a plurality of through holes cut through said semispherical crown in communication with said bottom accommodation open chamber and a brim extending around said semispherical crown;

a metal wire ring fastened to a border edge of said brim of said hat;

a cap detachably accommodated in said bottom accommodation open chamber of said hat for capping on the head of a person, said cap comprising a plurality of through holes cut through opposing top and bottom sides thereof; and a fastening means adapted for securing said cap to said hat.

2. The collapsible head covering device as claimed in claim 1, wherein said fastening means is a fastening belt selectively insertable through the through holes of said hat and the through holes of said cap to adjustably secure said cap to said hat to one of a series of angular positions.

3. The collapsible head covering device as claimed in claim 1, wherein said metal wire ring is a memory metal wire ring.

4. The collapsible head covering device as claimed in claim 1, further comprising a shade, said shade comprising a tubular shade body made of an anti-UV waterproof fabric, said tubular shade body having opposing top and bottom ends, a supplementary metal wire ring fastened to the bottom end of said tubular shade body of said shade, and a plurality of connecting strips connected between said hat and the top end of said tubular body of said shade.

5. The collapsible head covering device as claimed in claim 4, wherein said supplementary metal wire ring is a memory metal wire ring.

* * * * *